US009029743B2

(12) United States Patent
Watson et al.

(10) Patent No.: US 9,029,743 B2
(45) Date of Patent: May 12, 2015

(54) HEATING APPARATUS FOR AN APPLIANCE

(75) Inventors: Eric K. Watson, Crestwood, KY (US); Timothy Allen Hamel, Louisville, KY (US); Denis Alagic, Lexington, KY (US)

(73) Assignee: General Electric Company, Schenectady, NY (US)

( * ) Notice: Subject to any disclaimer, the term of this patent is extended or adjusted under 35 U.S.C. 154(b) by 1749 days.

(21) Appl. No.: 12/196,843

(22) Filed: Aug. 22, 2008

(65) Prior Publication Data

US 2010/0043486 A1 Feb. 25, 2010

(51) Int. Cl.
*H05B 6/02* (2006.01)
*F25D 23/12* (2006.01)

(52) U.S. Cl.
CPC ..... *F25D 23/12* (2013.01); *F25D 2400/02* (2013.01); *H05B 6/02* (2013.01)

(58) Field of Classification Search
CPC ..... F25D 23/12; F25D 2400/02; H05B 6/02; H05B 6/06
USPC ..... 219/201, 600, 620–622, 624, 645, 660, 219/664, 635; 62/351, 459, 480, 460
See application file for complete search history.

(56) References Cited

U.S. PATENT DOCUMENTS

| | | | | |
|---|---|---|---|---|
| 4,442,331 | A * | 4/1984 | Watanabe | 219/643 |
| 4,734,643 | A * | 3/1988 | Bubenik et al. | 324/232 |
| 5,839,507 | A * | 11/1998 | Jensen | 165/263 |
| 6,576,878 | B2 * | 6/2003 | Thorpe et al. | 219/645 |
| 2005/0115266 | A1 * | 6/2005 | Lim et al. | 62/351 |
| 2008/0295537 | A1 * | 12/2008 | An et al. | 62/344 |
| 2009/0165492 | A1 * | 7/2009 | Wilson et al. | 62/344 |

FOREIGN PATENT DOCUMENTS

| | | | | |
|---|---|---|---|---|
| JP | 09250863 | * | 9/1997 | F25D 21/08 |
| JP | 2007107310 A | * | 10/2005 | E02B 7/20 |

* cited by examiner

*Primary Examiner* — Dana Ross
*Assistant Examiner* — James Sims, III
(74) *Attorney, Agent, or Firm* — Global Patent Application; Douglas D. Zhang

(57) ABSTRACT

A heating apparatus for heating a subcompartment in a compartment of an appliance is disclosed. The heating apparatus includes an electromagnetic member disposed in the compartment, and a metal member thermally coupled to the subcompartment. The metal member is magnetically coupled to the electromagnetic member to generate an eddy current in the metal member in response to a magnetic field generated by the electromagnetic member for heating the subcompartment. A related heating method and a refrigerator incorporating such a heating apparatus are also disclosed.

9 Claims, 3 Drawing Sheets

HEATING APPARATUS FOR AN APPLIANCE

BACKGROUND OF THE INVENTION

The present invention relates generally to a heating apparatus for an appliance. More particularly, the present invention relates to a heating apparatus for heating a subcompartment disposed in a compartment of a refrigerator so as to maintain the temperature of the subcompartment higher than that of the compartment, a refrigerator employing the heating apparatus, and a method of heating a subcompartment disposed in a compartment of a refrigerator.

Generally, a refrigerator includes a freezer compartment and a fresh food compartment, which are partitioned from each other to store various foods at low temperatures in appropriate states for a long time.

For example, the freezer compartment is used to freeze meat, poultry and fish so that they can be stored for a longer period of time. However, the food in the freezer compartment is usually frozen hard at normal freezing temperature, which makes it difficult to cut and prepare. Accordingly, a soft freezing concept has been conceived to solve this problem, which proposes a subcompartment disposed in the freezer compartment and maintains the temperature of the subcompartment higher than that of the freezer compartment, for example, around 10° F. higher that the temperature of the freezer compartment. For example, the heated subcompartment can be mounted to the door of the freezer compartment to provide a storing space having an elevated temperature. The temperature of the subcompartment should be maintained to allow easy cutting and preparing of the food as well as medium term storage.

A heated subcompartment has been used in connection with the fresh food compartment, which is suitable for storing fruit, vegetables, dairy products, chilled liquids and other food stuffs that would otherwise be spoiled at standard room temperature, but are not desired to be frozen. For example, U.S. Pat. No. 5,839,507 discloses a heated butter conditioner mounted in the door of a fresh food compartment. The temperature of the butter conditioner is maintained higher than that of the fresh food compartment to soften the surface of the butter stored in the conditioner, so as to facilitating the slicing and spreading of the butter.

Conventionally, it is necessary to provide electric wires within the door of either a freezer compartment or a fresh food compartment, for implementing an electrical connection between a major compartment and its subcompartment, thereby energizing the heating elements mounted to the subcompartment to heat the subcompartment to a desirable temperature. This configuration incurs disadvantages, which include, among others, structural complexity of the door because of the disposition of electric wires in the door. In addition, since the main board power supply of the refrigerator may not be sufficient to energize the heating element disposed in the door, an extra power supply may be needed.

Therefore, it would be desirable to provide an advantageous configuration for implementing a heated subcompartment with high heating efficiency, without requiring electrical wiring in the door of a compartment and an extra power supply.

BRIEF DESCRIPTION OF THE INVENTION

As described herein, the various exemplary embodiments of the present invention overcome one or more of the above or other disadvantages known in the art.

One aspect of the present invention relates to a heating apparatus for heating a subcompartment in a compartment of an appliance. The heating apparatus includes an electromagnetic member disposed in the compartment, and a metal member thermally coupled to the subcompartment. The metal member is magnetically coupled to the electromagnetic member to generate an eddy current therein in response to a magnetic field generated by the electromagnetic member for heating the subcompartment.

Another aspect of the present invention relates to an appliance such as a refrigerator. The refrigerator includes a compartment having a door for selectively closing an access of the compartment; a subcompartment disposed in the compartment; an electromagnetic member disposed in the compartment; and a metal member thermally coupled to the subcompartment. The metal member is magnetically coupled to the electromagnetic member to generate an eddy current therein in response to a magnetic field generated by the electromagnetic member for heating the subcompartment so that the subcompartment has a temperature which is higher than a temperature of the compartment.

Yet another aspect of the present invention relates to a method of heating a subcompartment in a compartment of a refrigerator. The method includes providing an electromagnetic member in the compartment and providing a metal member thermally coupled to the subcompartment. The method further includes generating a magnetic field by the electromagnetic member, magnetically coupling the electromagnetic member to the metal member to generate an eddy current in the metal member in response to the magnetic field for heating the subcompartment.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE PREFERRED EMBODIMENTS OF THE INVENTION

It is contemplated that the teaching of the description set forth below is applicable to all types of refrigeration appliances, including but not limited to household refrigerators. The present invention is therefore not intended to be limited to any particular refrigeration apparatus or configuration described in the exemplary embodiments of the present invention.

Figure 1:
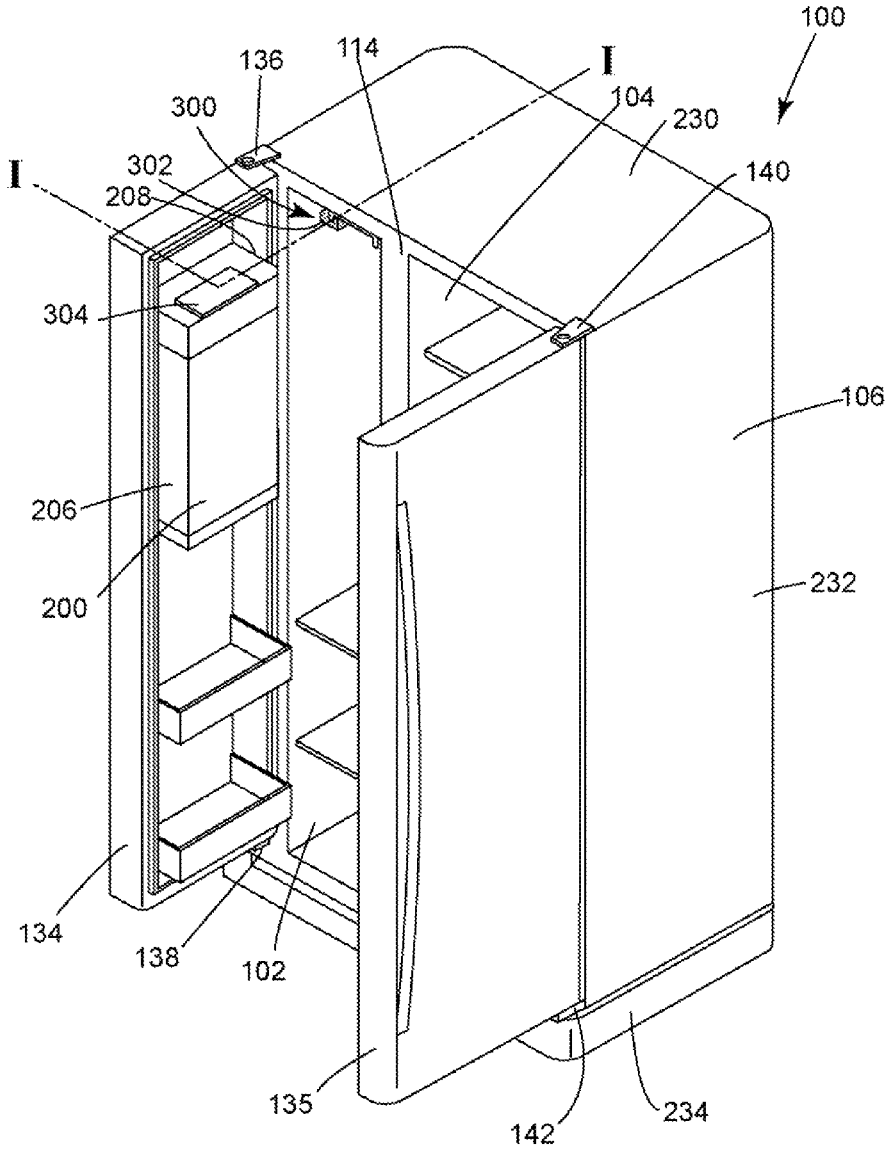
FIG. 1 is a perspective view of a refrigerator having a heating apparatus according to an exemplary embodiment of the present invention, with the doors for the compartments of the refrigerator being open.
Figure 2:
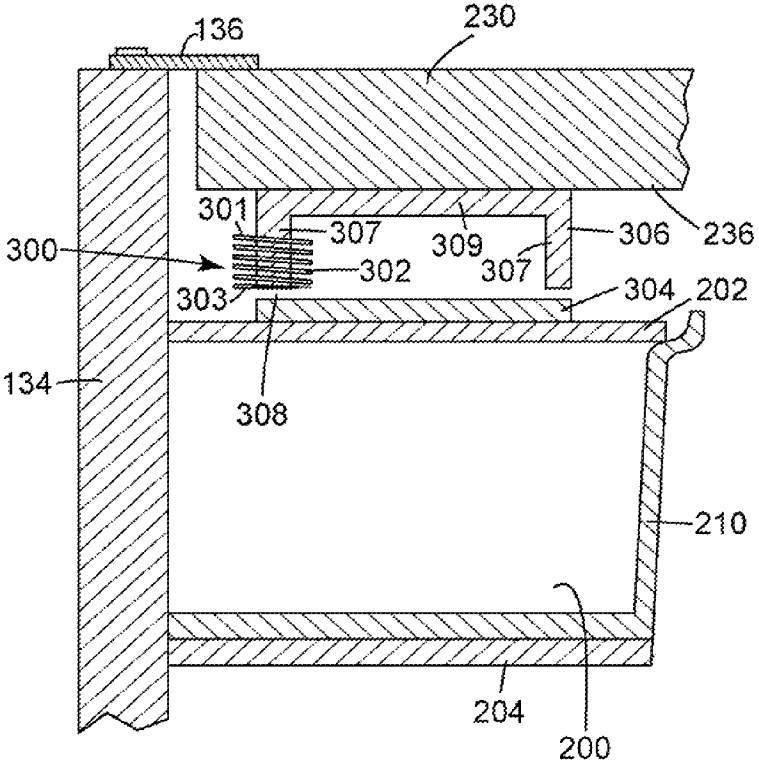
FIG. 2 is a partial sectional view of the refrigerator of FIG. 1 along lines I-I in FIG. 1, showing the heating apparatus in a subcompartment disposed in one compartment of the refrigerator when the door of the one compartment is closed.
Figure 3:
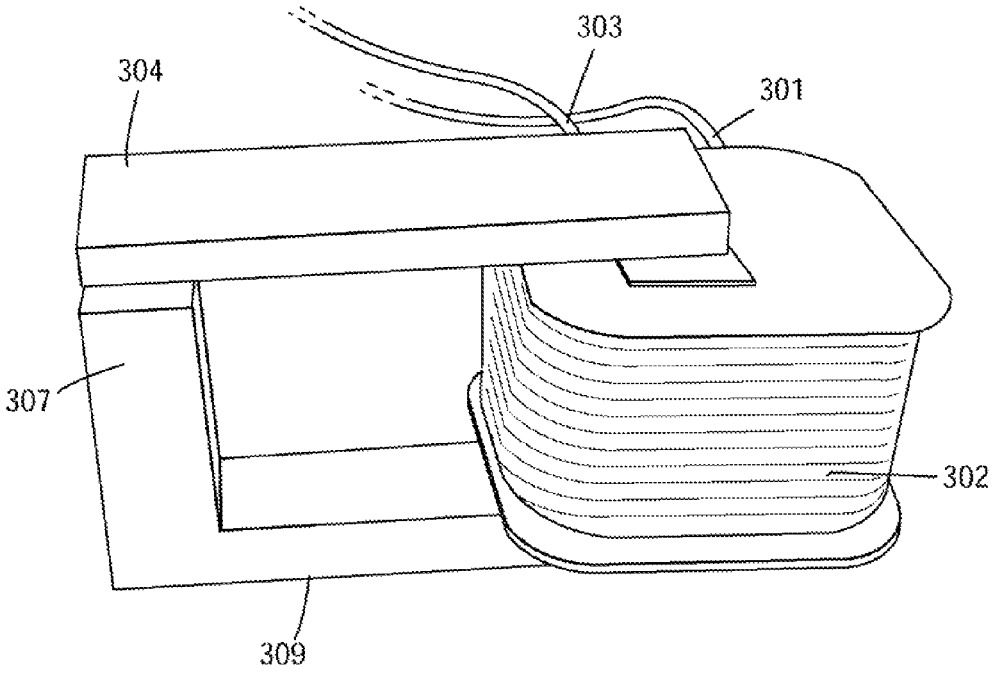
FIG. 3 is a schematic perspective view of the heating apparatus of FIG. 2, separated from the refrigerator.

FIGS. 1-3 illustrate an exemplary embodiment of the present invention. As shown in FIG. 1, a "side-by-side" type refrigerator 100 includes a freezer compartment 102 arranged to the side of a fresh food compartment 104. The freezer compartment 102 is shown with an access door 134 and the fresh food compartment 104 is shown with an access door 135. However, it should be understood that the exemplary embodiment of the present invention is also applicable to any other type of refrigerators, such as a bottom freezer or top freezer refrigerator.

The fresh food compartment 102 and the freezer compartment 104 are defined in part by a main body having an outer case 106. The outer case 106, for example, is formed by folding a sheet of a suitable material, such as pre-painted steel, into a generally inverted U-shape and by adding a thermally insulating liner to the folded sheet to form a top 230 and two sidewalls 232 of the outer case 106. The outer case 106 also has a back (not shown) and a bottom 234, which connects the two sidewalls 232 to each other at the bottom edges thereof. A dividing wall 114, which is for example formed of an extruded ABS material, connects the top 230 and the bottom 234 to each other and separates the freezer compartment 102 from the fresh food compartment 104.

The access doors 134, 135 close access openings to the freezer compartment 102 and the fresh food compartment 104, respectively.

The access door 134 is mounted to the main body by a top hinge 136 and a corresponding bottom hinge 138 so that the access door 134 is rotatable about the outer vertical edge of the freezer compartment 102 between an open position for accessing the freezer compartment, as shown in FIG. 1, and a closed position for closing the freezer compartment. Similarly, the access door 135 is mounted to the main body by a top hinge 140 and a corresponding bottom hinge 142 so that the access door 135 is rotatable about the outer vertical edge of the fresh food compartment 104.

The refrigerator 100 further includes a subcompartment 200 supported by the access door 134 of the freezer compartment 102. The subcompartment 200 is a heated compartment having a temperature around, for example, 10° F. higher than that of the freezer compartment 102. The subcompartment 200 is used to maintain the food stored therein soft enough to be easily sliced while being frozen. However, it should be understood that the subcompartment 200 may be disposed in the fresh food compartment 104 instead of the freezer compartment 102, and in that case, the temperature of the subcompartment is maintained slightly higher than that of the fresh food compartment 104 to, for example, allow the butter stored therein to be easily spread. In addition, it should be understood that, although the exemplary embodiment is described in connection with the configuration wherein the subcompartment 200 is supported by the access door 134, the subcompartment 200 can be disposed within the freezer compartment 102 or the fresh food compartment 104 without departing from the present invention.

The refrigerator 100 further includes a heating apparatus 300, configured to heat the subcompartment 200. The heating apparatus 300 includes a primary, electromagnetic member 302 disposed in the freezer compartment 102, and a secondary member such as the metal member 304 attached to the subcompartment 200.

The electromagnetic member 302 is energized by a power supply, for example, a 120 VAC power supply, to generate a magnetic field. Specifically, the electromagnetic member 302 and metal member 304 are disposed in such a way that when the access door 134 is closed, the electromagnetic member 302 and metal member 304 are sufficiently close to be magnetically coupled to each other. Thus, an eddy current is induced in the metal member 304 in response to the magnetic field generated by the electromagnetic member 302. Accordingly, Joule heating of the metal member 304 is implemented due to the eddy current, which in turn elevates the temperature within the subcompartment 200.

A detailed description of the heating apparatus 300 and the subcompartment 200 will be made in the following with reference to FIG. 2. As shown in FIG. 2, the electromagnetic member 302 is shown as a coil energized by a power supply through an electric input 301 and an electric output 303. The coil 302 may include insulating layers or cover (not shown) for safety purposes. The metal member 304 is shown as a metal plate made of a readily magnetizable composition, for example, soft steel.

The heating apparatus 300 further includes a laminated, substantially U-shaped metal section 306 having a pair of wings 307. The U-shaped metal section 306 is magnetically coupled to the coil 302 by inserting a wing 307 of the U-shaped metal section 306 into the coil 302. The U-shaped metal section 306 serves as a flux concentrator for lowering the loss of magnetic lines of flux of the magnetic field generated by the coil 302, since the lines of flux travel at a much lower loss in the U-shaped metal section 306 than in the air. Furthermore, due to the laminated structure of the U-shaped metal section 306, substantially no eddy current is induced in the U-shaped metal section 306.

For example, the coil 302 and the U-shaped metal section 306 may be formed as a unitary member within an enclosure, to improve the safety and appearance of the refrigerator 100. In this case, the U-shaped metal section 306 is mounted, for example, to the inner surface 236 of the top 230 of the refrigerator 100 by attaching the flat portion 309 of the U-shaped metal section 306 to the inner surface 236 of the top 230. The coil 302, surrounding the wing 307 of the U-shaped metal section 306, is fixed to the U-shaped metal section 306. However, it should be understood that the coil 302 may have its own supporting structure for mounting the coil 302 onto the inner surface 236 of the top 230 of the refrigerator 100.

In the embodiment shown in FIGS. 1 and 2, the subcompartment 200 includes a top wall 202, a bottom wall 204 substantially parallel to the top wall 202 and a pair of side walls 206, 208 (as best seen in FIG. 1), defining a cavity, into which a drawer 210 slidably moves. These walls could be formed integrally with the door liner and foam filled for insulation, or they could be made separately of suitable insulating material and supported from the door. Preferably, the walls forming the subcompartment should have sufficient thermal insulating capability to sustain the higher temperature in the subcompartment and to not substantially adversely affect the temperature of the compartment. Thus the subcompartment 200 is able to provide an enclosed storing space in the freezer compartment 102, when the access door 134 is closed.

However, it should be understood that the configuration of the subcompartment is not limited to the above-described embodiment. The subcompartment 200 may have any other suitable structure depending the design of refrigerator 100 and the configuration of the heating apparatus 300. For example, the coil 302 and the U-shaped metal section 306 may be disposed on the bottom 234 of the refrigerator 100 with the coil 302 seated on the U-shaped metal section 306, and the metal plate 304 may be accordingly disposed on the lower surface of the bottom board 204, to heat the subcompartment 200 to achieve an elevated temperature in the subcompartment 200. Of course, in this configuration, the subcompartment 200 is disposed adjacent to the bottom of the access door 134. Moreover, an access door can be used to replace the drawer 210.

As depicted in FIG. 2, the metal plate 304 is supported by the top wall 202. More specifically, it is disposed in a suitable opening formed in the top wall 202. This could be achieved by molding the metal plate 304 in place when the liner is formed or as an detachable element relative to the top wall 202, which is inserted in the opening after forming to facilitate assembly and replacement of the metal plate 304.

The orientation and location of the metal plate 304 and the laminated U-shaped metal section 306 should be predetermined to assure that, when the access door 134 is closed, the metal plate 304 and the laminated U-shaped metal section 306 form a substantially closed magnetic circuit, through which the lines of flux of the magnetic field generated by the coil 302 flow. In the shown exemplary embodiment, a gap 308 is formed between the lower surface of the wings 307 of the U-shaped metal section 306 and the upper surface of the metal plate 304. However, the wings 307 may contact the metal plate 304 directly, to provide a closed-loop magnetic circuit, which is able to effectively prevent the magnetic power from falling due to the gap there between.

FIG. 3 is a schematic perspective view illustrating the heating apparatus 300 shown in FIG. 2. As shown in FIG. 3, the metal plate 304 contacts the U-shaped metal section 306 to form a closed-loop magnetic circuit. The coil 302 surrounds one of the wings 307 of the U-shaped metal section. The coil 302 is energized by a power supply, such as a 120 VAC power supply from the main board power supply (not shown) of the refrigerator 100. The electric inlet 301 and electric outlet 303 are wired to the power supply through a wiring formed within the outer case 106 of the refrigerator 100.

As discussed above, the induced eddy current in the metal plate 304 is used to heat the subcompartment 200 through the magnetic coupling between the metal plate 304 and the coil 302. Thus, it is not required to form electrical wiring within the access door 134 of the refrigerator 100 for maintaining an electrical connection between the access door 134 and the outer case 106. Furthermore, no extra DC power supply is required to supplement the power supply from the main board power supply of the refrigerator 100. Accordingly, the structure of the access door 134 is kept simple and the manufacturing cost of the entire refrigerator 100 is cut down.

Figure 4:
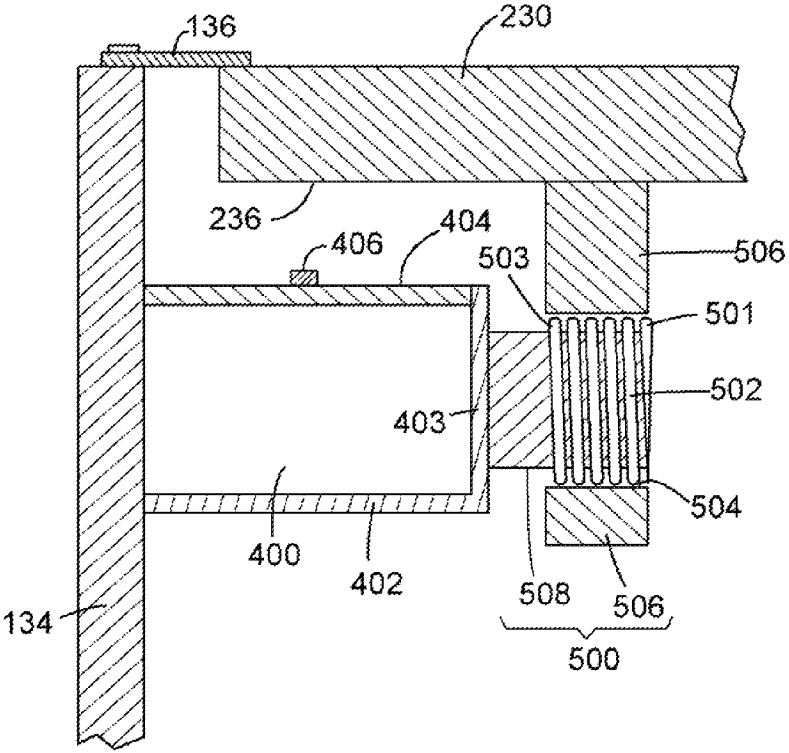
FIG. 4 is a partial sectional view of a heating apparatus and a subcompartment according to another exemplary embodiment of the present invention.

FIG. 4 is a partial sectional view illustrating a subcompartment 400 and a heating apparatus 500 according to another exemplary embodiment of the present invention. The subcompartment 400 and the heating apparatus 500 will be described in the context of the refrigerator 100 shown in FIGS. 1-3.

The subcompartment 400 includes a bottom wall 402 projecting from the inner surface of the access door 134, a front wall 403 extending upwardly from the inwardly projecting end of the bottom wall 402, and a pair of opposite side walls (not shown) connecting the bottom wall 402 and the front wall 403. The bottom wall 402, the front wall 403, the side walls and the access door 134, define a substantial container with an opening facing upward. The subcompartment 400 preferably further includes a cover member 404 closing the opening of the container, thereby providing an enclosed space in the subcompartment 400 for storing food. The subcompartment 400 further includes a handle 406 formed on the upper surface of the cover member 404.

The heating apparatus 500 includes an electromagnetic member such as a coil 502 mounted in a cavity 504 of a supporting member such as a supporting beam 506. The supporting beam 506 is attached to the inner surface of the refrigerator 100. For example, the supporting beam 506 can be in the form of a plate depending from the inner surface 236 of the top 230. The cavity 504 is, for example, a substantially round through hole for accommodating the coil 502. The heating apparatus 500 further includes a metal member such as a metal rod 508 which could be attached to and project through the front wall 403 of the subcompartment 400 so as to expose at least the end surface of the metal rod 508 to the interior of subcompartment 400. Alternatively, at least part of the front wall 403 that is in direct contact with the metal rod 508 is thermally and/or electrically conductive to deliver heat from the metal rod 508 to the interior of subcompartment 400. The metal rod 508 is dimensioned and shaped to be complementary to the dimension and shape of the coil 502, such that, when the access door 134 is closed, the metal rod 508 is at least partially inserted into and magnetically coupled to the coil 502. Similarly, the coil 502 includes an electric inlet 501 and an electric outlet 503 wired to a power supply for the refrigerator 100.

In this embodiment, when the access door 134 is closed, the metal rod 508 is at least partially inserted into the coil 502. Thus, when the coil 502 is energized by, for example, a 120 VAC power supply, a magnetic field is generated by the coil 502, and an eddy current is in turn induced in the metal rod 508 responsive to the magnetic field. The heat generated by Joule heating derived from the eddy current is subsequently transferred to the subcompartment 400, to achieve a storing space having an elevated temperature compared to that of the freezer compartment 102. In this embodiment, the magnetic lines of flux of the magnetic field are concentrated inside the coil 502. Thus, the insertion of the metal rod 508 into the coil 502 is able to achieve an effective and efficient magnetic coupling between the coil 502 and the metal rod 508.

The heat generating capacity of the above-described heating apparatus 300 and 500, by means of induction of eddy currents within the metal members 304 and 508 of the apparatus, is affected by several factors including the current flowing in the coil 302 and 502, and the ability of the metal plate 304 and the metal rod 508 to accept lines of flux of the magnetic fields generated by the respective coils. In this regard, for example, the metal members may be made of ferromagnetic materials, such as soft steel. The coils 302 and 502 may be energized with an AC power supply having a high frequency.

Thus, while there have shown and described and pointed out fundamental novel features of the invention as applied to various specific embodiments thereof, it will be understood that various omissions and substitutions and changes in the form and details of the apparatus illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A refrigerator comprising:

an outer case;

a compartment disposed in the outer case;

a door for selectively closing an access of the compartment;

a subcompartment disposed on the door; and a heating apparatus configured to heat the subcompartment, the heating apparatus comprising:

an electromagnetic member comprising a coil disposed in the compartment; and a metal member comprising one of a metal plate and a metal rod attached to the subcompartment, wherein the coil is energizable by an AC power supply from a main board power supply of the refrigerator through an electric input and an electric output, wherein the electric input and electric output are wired to the main board power supply through a wiring formed within the outer case of the refrigerator, and wherein when the door is closed the metal member and the electromagnetic member are sufficiently close to one another such that the metal member and the electromagnetic member are magnetically coupled and the heating apparatus generates an eddy current in the metal member in response to a magnetic field generated by the electromagnetic member thereby heating the subcompartment to a temperature higher than a temperature of the compartment.

2. The refrigerator of claim 1, wherein the electromagnetic member further comprises a flux amplifier for lowering the loss of magnetic lines of flux of the magnetic field generated by the electromagnetic member.

3. The refrigerator of claim 2, wherein the flux amplifier comprises a laminated, generally U-shaped metal section having a pair of wings, one of which is inserted into the coil.

4. The refrigerator of claim 3, wherein the metal member comprises the metal plate, the metal plate magnetically being coupled to the laminated, generally U-shaped metal section when the door is closed to form a substantially closed magnetic circuit with the laminated, generally U-shaped metal section.

5. The refrigerator of claim 1, wherein the metal member comprises the metal rod insertable into the coil.

6. The refrigerator of claim 1, wherein the metal member comprises soft steel.

7. The refrigerator of claim 1, wherein the compartment is a freezer compartment.

8. The refrigerator of claim 1, wherein the compartment is a fresh food compartment.

9. The refrigerator of claim 1, wherein the metal member is spaced apart from the electromagnetic member so that there is a space between the metal member and the electromagnetic member when the door is closed.

* * * * *